United States Patent [19]

Mommaerts et al.

[11] 3,984,515

[45] Oct. 5, 1976

[54] POLYACRYLONITRILE FIBERS HAVING A NATURAL CRIMP AND PROCESS FOR PRODUCING THE SAME

[75] Inventors: Henri-Albert Mommaerts, Brussels; Andre-Edgard Dubois, Ath, both of Belgium

[73] Assignee: Akzo Belge S.A., Brussels, Belgium

[22] Filed: Mar. 5, 1973

[21] Appl. No.: 337,823

[30] Foreign Application Priority Data

Mar. 7, 1972 Netherlands ..... 7203038

[52] U.S. Cl. ..... 264/182; 260/2.5 E; 264/45.5; 264/206; 264/210 F; 428/369; 428/376; 428/394; 428/398; 428/400

[51] Int. Cl.[2] ..... B29D 27/00; D01D 5/12; D01F 6/18; D01F 11/04

[58] Field of Search ..... 161/175, 178, 180; 264/53, 182, 206, 210, 234, 210 F; 260/2.5 E, 33.8 UA

[56] References Cited

UNITED STATES PATENTS

| | | | |
|---|---|---|---|
| 3,052,643 | 9/1962 | Lineberry | 260/2.5 E |
| 3,577,499 | 5/1971 | Knudsen | 264/182 |
| 3,655,857 | 4/1972 | Bohrer et al. | 264/182 |
| 3,706,828 | 12/1972 | Tzentis | 264/182 |

FOREIGN PATENTS OR APPLICATIONS

| | | | |
|---|---|---|---|
| 1,271,610 | 8/1961 | France | 264/182 |
| 1,334,857 | 7/1963 | France | 264/182 |
| 711,344 | 6/1954 | United Kingdom | 264/182 |
| 1,032,992 | 6/1966 | United Kingdom | 264/182 |
| 1,064,718 | 4/1967 | United Kingdom | 264/182 |
| 1,106,581 | 3/1968 | United Kingdom | 260/2.5 E |

OTHER PUBLICATIONS

Moncrieff, Man-Made Fibers, 5th Edit. Wiley Interscience, New York, (1970) pp. 506, 516, 545.

AATCC Technical Manual 49 (1973) 59–60.

*Primary Examiner*—J.C. Cannon
*Attorney, Agent, or Firm*—Sherman & Shalloway

[57] ABSTRACT

A naturally crimped polyacrylonitrile fiber having an asymmetrical cross section, the cross section having at least two large oblong lobes, the angle between at least two of these lobes being less than 90°, the fiber having an outer structure which has a relatively high density and has a variable thickness, this outer structure enclosing an inner structure which is porous and less dense than the outer structure.

The process for producing crimped polyacrylonitrile fibers comprises spinning a solution of a polyacrylonitrile polymer into a cold bath at a temperature of less than 30°C., this cold bath having low coagulation power for the polyacrylonitrile polymer and comprising 1,1,1-trichloroethane or mixtures of 1,1,1-trichloroethane with less than 25 percent of a solvent for the polyacrylonitrile, exposing the polyacrylonitrile to the cold bath for an exposure time of less than two minutes; drawing the partially coagulated filaments in a hot spinning bath at a draw ratio of greater than 200 percent, the spinning bath having a temperature between 60°C. and a boiling point of the spinning bath, the composition of the spinning bath comprising either water or water mixed with up to 75 percent solvent for the polyacrylonitrile. The fibers are then washed followed by heat treating the fibers in a free state, without tension, so as to allow the same to naturally crimp.

4 Claims, 8 Drawing Figures

Figure 1A:
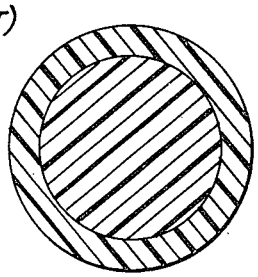
FIG. 1a (PRIOR ART)

POLYACRYLONITRILE FIBERS HAVING A NATURAL CRIMP AND PROCESS FOR PRODUCING THE SAME

This invention relates to naturally crimped polyacrylonitrile fibers and a process for producing the same. More particularly, this invention relates to a process for producing naturally crimped polyacrylonitrile fibers having an asymmetrical cross section by spinning the polyacrylonitrile into a first bath solution, this bath solution being a poor coagulating bath for the polyacrylonitrile and drawing the fibers in a second bath solution in order to completely coagulate the fibers.

As utilized herein, the terms acrylonitrile polymers or polyacrylonitrile are defined as homopolymers of acrylonitrile or copolymers of acrylonitrile, either graft copolymers, block copolymers, or other interpolymers containing up to 50% by weight of an additional ethylenically unsaturated compound and also homogeneous mixtures of various homopolymers of acrylonitrile, copolymers of acrylonitrile, or mixtures of homopolymers of acrylonitrile and various copolymers of acrylonitrile.

Also as utilized herein, the term natural crimp is defined as crimping obtained by utilizing special spinning conditions, especially special spinning baths, with the proviso that this term excludes any crimp formed by the shrinkage of a filament produced from two or more components having different shrinkage properties, i.e., bi-component type fibers and filaments.

Synthetic fibers and filaments have a wide variety of uses and many very valuable properties. However, the natural characteristics of these synthetic filaments including polyester, polyacrylonitrile, and other synthetic monofilaments and similar filaments do not have an aesthetically pleasing surface texture. Fiber makers and other manufacturers have attempted to make these man made or synthetic fibers to appear more like naturally occurring fibers i.e., wool, cotton, etc. by curling or crimping the same by a variety of mechanical or shrinkage crimping processes. Polyacrylonitrile fibers have been produced by both of these means, i.e., mechanical crimping means such as stuffer boxes, false twisting, etc. subsequent to the production of the filaments and shrinkage crimping such as bi-component filaments.

These mechanical crimping processes can be utilized only subsequent to the complete spinning and treating of the filaments, either in the wet spinning or dry spinning technique and require additional costly processes, steps, and apparatus. Although these processes produce a crimped polyacrylonitrile fiber with excellent initial properties with regard to crimp level, tightness, etc., these crimped fibers are not particularly stable, especially when they are heated or saturated during subsequent treatments.

The disadvantages inherent in the mechanically crimped polyacrylonitrile fibers have led to the utilization of the so called bi-component fibers having either a side by side or a sheath-core relationship wherein two compounds or polymer solutions having a different shrinking characteristic are extruded, either side by side or in a sheath-core or similar relationship. These fibers have different shrinking characteristic so that upon subsequent treatment, such as drawing, spinning, heating relationship, etc., a natural crimp is formed. While these bi-component fibers produce filaments of polyacrylonitrile having excellent crimp reversal, tightness, etc., these processes do require the utilization of special extrusion equipment so that the two particular components of the final bi-component fiber may be extruded in the proper cross-sectional relationship. The control of the relative ratio between the two components in a bi-component fiber extrusion process has led to a great number of adaptations and variations in the basic processes for co-extruding at least two filaments. Numerous techniques and apparatus have been developed so that this co-extrusion may be conducted in a more uniform manner to produce a fiber having a regular crimp.

The difficulties inherent in the bi-component type polyacrylonitrile fibers have led to the development of processes for producing a naturally crimped polyacrylonitrile fiber from a single composition of polyacrylonitrile. However, these processes which often involve high temperatures and unusual spinning baths have not produced crimped polyacrylonitrile fibers having a tight, reversible crimp which is stable when subjected to subsequent post treatments.

It therefore is within the above environment and background that the product and process of the present invention were developed.

Briefly, the present invention is directed to a method for producing naturaly crimped polyacrylonitrile fibers from a spinning solution comprising the polyacrylonitrile dissolved in a solvent for the polyacrylonitrile. This spinning solution is first spun into a cold bath having a temperature less than 30°C., this bath having a low coagulation power for the polyacrylonitrile and containing 1,1,1 -trichlorethane or a mixture of 1,1,1-trichlorethane with less than 25 percent by weight of a solvent for the polyacrylonitrile, exposing the polyacrylonitrile to the cold bath for an exposure time of less than two minutes to form a partially coagulated polyacrylonitrile filament, drawing the filament in a hot bath having a temperature between 60°C. and the boiling point of the hot bath, this hot bath having a higher coagulation power for the polyacrylonitrile, the polyacrylonitrile being drawn to a draw ratio of greater than 200 percent, washing the filaments and heat treating the filaments without tension to develop the crimp.

The crimped polyacrylonitrile filaments of the present invention comprise polyacrylonitrile filaments having an asymmetrical cross section, these filaments having a relatively dense outer structure of variable thickness enclosing a porous inner structure which is relatively less dense than the outer structure, the cross section of these filaments having at least two large oblong lobes, the angle between at least two of these lobes being less than 90°.

It is therefore the primary object of the present invention to provide a process for producing naturally crimped polyacrylonitrile fibers in a simple and expeditious manner.

It is a further object of the present invention to provide a naturally crimped polyacrylonitrile fiber wherein the crimp is tight, reversible, and quite stable.

It is still a further object of the present invention to provide a process for producing polyacrylonitrile fibers by spinning the fibers into a first bath having a low coagulation power for the polymers and subsequently drawing these initially formed fibers in a second bath having a high degree of coagulating power for the polymers.

It is a still further object of the present invention to provide a polyacrylonitrile fiber having an asymmetrical cross section both with regard to cross sectional shape and density.

Still further objects and advantages of the process of the present invention and the product produced thereby will become more apparent from the following more detailed description thereof.

The process of the present invention comprises spinning a polyacrylonitrile polymer solution, this polymer solution comprising polyacrylonitrile and a solvent for the polyacrylonitrile, into a cold bath having a temperature less than 30°C., this bath having a low coagulating power for the polyacrylonitrile and containing 1,1,1-trichlorethane or mixtures of 1,1,1-trichlorethane with less than 25 percent of a solvent for the polyacrylonitrile; exposing the polyacrylonitrile solution to this cold bath for an exposure time of less than two minutes to form partially coagulated polyacrylonitrile filaments, drawing these partially coagulated polyacrylonitrile filaments to a draw ratio of greater than 200 percent in a hot bath having a temperature between 60°C. and the boiling point of the hot bath, this hot bath having a high coagulating power for the polyacrylonitrile and comprising water or mixtures of water with up to 75 percent by weight of solvent for the polyacrylonitrile, washing the polyacrylonitrile filaments, and heat treating these polyacrylonitrile filaments in a free state without tension so as to allow the same to naturally crimp.

The product of the present invention comprises a polyacrylonitrile filament having an asymmetrical cross section, this filament having an outer structure of variable thickness having a relatively high density, this outer structure enclosing a porous inner structure, this inner structure being relatively less dense than the outer structure, the cross section of these filaments having at least two large oblong lobes, the angle between at least two of these lobes being less than 90°C.

As stated above, there have been very many attempts to produce naturally crimped polyacrylonitrile fibers without resorting to mechanical crimping or utilizing the bi-component spinning method. The natural curling or crimping of these filaments, both bi-component and mono-component filaments, occurs when the filaments are boiled, dried, and/or steamed without tension on the filaments so as to allow the filaments to shrink, thereby producing internal stresses which produces the natural crimp.

By producing the filaments of the present invention according to the process of the present invention, a monofilament is formed, having an asymmetrical cross sectional structure, each of these sections having a different shrinkage value so that natural crimping occurs when the fibers are subjected to subsequent treatments, such as boiling, drying, steaming, etc. without any tension on the filaments.

The polyacrylonitrile fibers of the present invention comprise either homopolymers of polyacrylonitrile or various copolymers of acrylonitrile containing up to 50% by weight of an additional ethylenically unsaturated compound. These copolymers of polyacrylonitrile can be block, graft, or other types of copolymers.

Suitable ethylenically unsaturated compounds which can be copolymerized with the acrylonitrile include vinyl chloride, vinyl acetate, vinylidene chloride; acrylic acid, methacrylic acid; esters and amides of acrylic and methacrylic acid; compounds containing a carboxylic acid group, i.e., itaconic acid, etc. or a sulfonic acid group such as vinylsulfonic compounds, i.e., allyl and methallyl sulfonic acids; sulfonated aromatic vinyl compounds, i.e., styrene sulfonic acids, vinyl oxyarene sulfonic acids, etc.; vinyl derivatives of basic nature such as vinyl pyridine and lower alkyl vinyl pyridines, vinyl dialkylamine ethers, etc.

These polymers of acrylonitrile are initially dissolved in a spinning solution also called a spinning dope which comprises the polyacrylonitrile and a solvent for the polyacrylonitrile such as dimethylformamide, dimethylacetamide, dimethylsufoxide, ethylene carbonate, etc. Any conventional solvent for the polyacrylonitrile fibers can be utilized in the process of the present invention, although the above four solvents are preferred.

These polymer solutions or spinning dopes are than spun into a cold spinning bath, this cold spinning bath having a low coagulating power for the polyacrylonitrile in the spinning dopes. The temperatures of this cold spinning bath must be less than 30°C. and preferably should be less than 25°C. The composition of the cold spinning bath utilized in the process of the present invention may be either pure 1,1,1-trichlorethane or mixtures of 1,1,1-trichlorethane with less than 25 percent by weight of a solvent for the polyacrylonitrile. Preferably, the composition of the cold spinning bath will comprise either 100 percent 1,1,1-trichlorethane or mixtures of 1,1,1-trichlorethane and less than 15 percent by weight of solvent for the polyacrylonitrile.

Although various other chlorinated solvents have been utilized as spinning baths for acrylonitrile fibers, such as carbon tetrachloride, ethylenedichloride, and a symmetrical tetrachlorethylene as described in Belgian Pat. No. 706,262, these spinning solutions do not produce crimped polyacrylonitrile fibers. Furthermore, in French Pat No. 1,271,610, the acrylonitrile is polymerized in a mixture of dimethyformamide and an organic liquid, which is not a solvent for the polyacrylonitrile. This special polymerization mixture, however, is then eventually coagulated in a bath of chlorinated hydrocarbons. However, again, the product of this process is an uncrimped acrylic fiber. In French Pat. No. 1,334,857, the fibers produced in accordance with French Pat. No. 1,271,610 are spontaneously crimped when stretched and dried without tension. However, as noted above, these acrylonitrile polymers are produced, utilizing a special polymerization technique. None of the above patents, however, has described the utilization of unsymmetrical chlorinated hydrocarbons and particularly none of these references has described the use of 1,1,1-trichlorethane as a spinning solution. Also, none of these patents has described the cross sectional structure of the products produced in the processes of the present invention, although as noted above, the fibers produced in accordance with the processes as set forth in French Pat. No. 1,334,857 do crimp spontaneously.

Furthermore, the excellent crimping properties produced utilizing a spinning bath of 1,1,1-trichlorethane as the sole or primary component are completely unexpected since when 1,1,2-trichlorethane is utilized as the sole or main component of the spinning baths with all of the other conditions of the process of the present invention being retained, the polyacrylonitrile fibers produced have virtually no natural crimp.

The polyacrylonitrile polymer solution, when spun into the cold spinning bath utilized in the process of the present invention, is exposed to the spinning bath for a minimum period of time so as to only partially coagulate the polyacrylonitrile. Generally, the exposure time in the cold spinning bath is less than two minutes, although it is preferable that the polyacrylonitrile solution be exposed to the cold spinning bath for an exposure time of less than one minute. Of course, the time spent in the first spinning bath is dependent upon the spinning velocity of the various spinning solutions.

Subsequent to the removal of the partially coagulated polyacrylonitrile filaments, these filaments are subjected to a second treating bath, this treating bath being a bath which has a high coagulating power for the polyacrylonitrile. The partially coagulated polyacrylonitrile fiber is subjected to a draw ratio of greater than 200 percent and preferably higher than 400 percent while in the hot second coagulating bath. This coagulating bath has a temperature of between 60°C and the boiling point of the bath, preferably between 80°C and 100 percent C.

Although any type of coagulating bath which has a high coagulating power for polyacrylonitrile can be utilized, it is preferred to utilize a coagulating bath comprising 25 to 100 percent by weight water and 0–75 percent by weight of a solvent for the polyacrylonitrile. Water is the preferred coagulating bath, but when a mixed aqueous bath is utilized, the bath preferably contains less than 60 percent by weight solvent for the polyacrylonitrile.

As noted above, the partially coagulated polyacrylonitrile fibers are drawn while in contact with this hot coagulating bath. If the partially coagulated polyacrylonitrile fibers are drawn before being treated with this hot coagulating bath or subsequent to being treated with this hot coagulating bath, polyacrylonitrile fibers are produced having virtually no crimping properties.

Subsequent to removal from the hot coagulating bath, the polyacrylonitrile fibers may be treated with any number of conventional treatments, such as washing, oiling, cutting, boiling, dyeing, drying and steaming in any other. In order to produce the natural crimp in the fibers of the present invention, it is found necessary to steam, boil, or dry the fibers while the same are in a relaxed state without any tension on the fibers. This allows the fibers to shrink and allows the outer structure which has a high density and the inner structure which has a porous structure and a low density to shrink at relatively different rates, thereby producing an naturally crimped polyacrylonitrile fiber. Although the crimping of the polyacrylonitrile fibers can be produced by boiling, drying, or steaming alone, it is found that the curling intensity of the polyacrylonitrile fibers is improved when the same are subjected to an initial drying process having a temperature of less than 60°C. In fact, it is found that the lower the initial drying temperature, the higher the curling percentage of the polyacrylonitrile fibers with the important factor in the drying temperature being the temperature at the beginning of the drying process. Although this initial drying treatment is not essential for the production of crimped polyacrylonitrile fibers in accordance with the process of the present invention, since it does produce acrylonitrile fibers having exceptionally high crimp, it is a preferred embodiment of the process of the present invention.

Figure 1B:
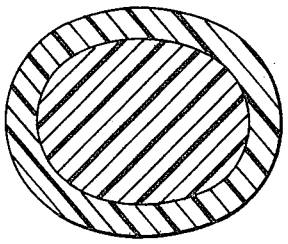
FIG. 1b (PRIOR ART)
Figure 1C:
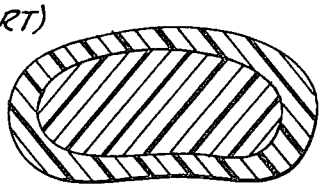
FIG. 1c (PRIOR ART)
Figure 1D:
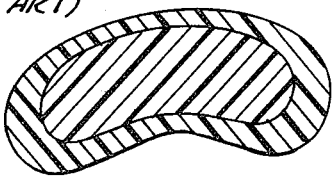
FIG. 1d (PRIOR ART)
Figure 2A:
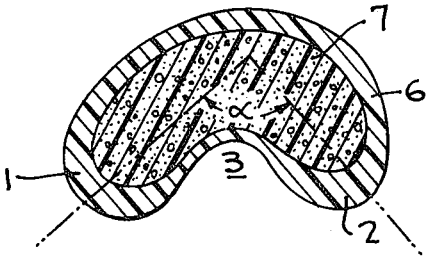
Figure 2B:
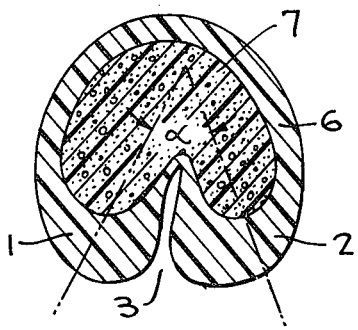
Figure 2C:
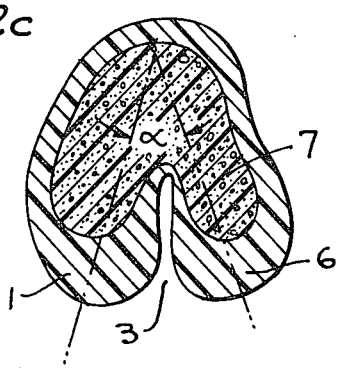
Figure 2D:
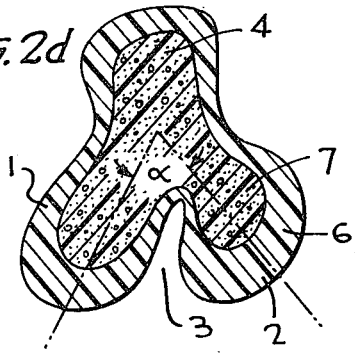

The polyacrylonitrile fibers which are produced in accordance with the process of the present invention, will be better understood with reference to the attached drawings where FIGS. 1 (*a*), (*b*), (*c*), and (*d*) schematically represent prior art polyacrylonitrile fiber cross sections; and FIGS. 2 (*a*), (*b*), (*c*), and (*d*) schematically represent cross sections of polyacrylonitrile fibers of the present invention.

As shown by FIGS. 1 (*a*) through (*d*), prior art polycrylonitrile fibers having an outer core and an inner structure are either round, elliptical, in the shape of a kidney bean, or similar type structure. None of these structures has at least two lobes which are large and oblong in shape, and further, the angle between the two lobes in FIG. 1 (*d*) is considerably greater than 90°. Upon shrinking, although there will be some internal stresses in the fibers as shown in FIGS. 1 (*a*) through (*d*), these fibers do not produce polyacrylonitrile fibers with a pronounced natural crimp.

As is seen with reference to FIG. 2 (*a*) through (*d*), the cross section of the fibers of the present invention has at least two lobes, 1 and 2, with the angle $\alpha$ between these two large lobes being less than 90°. When the angle $\alpha$ between lobes 1 and 2 is greater than 90°, there is not sufficient structural asymmetry in the polyacrylonitrile fibers to produce a stable properly crimped polyacrylonitrile fiber. When the angle $\alpha$ is less than 90° as shown in FIGS. 2(*a*) through (*d*), the two large oblong lobes 1 and 2 are separated by a notch 3. Furthermore, as shown in FIG. 2(*d*), the two large oblong lobes can be joined with a smaller third lobe 4 so as to form a polyacrylonitrile fiber having a trilobal cross sectional shape. However, it should be noted that the angle $\alpha$ between the large oblong lobes 1 and 2 must always be less than 90° and preferably less than 60° in order to produce polyacrylonitrile fibers having a stable natural crimp.

Also shown in FIGS. 2 (*a*) through (*d*) are the outer structure 6 and inner structure 7 of the fibers of the present invention. Basically, outer structure 6, which has a higher density than inner structure 7, has a variable thickness around the periphery of the polyacrylonitrile fiber. This variable thickness further adds to the structural asymmetry of the fibers of the present invention, such structural asymmetry not being found in many of the prior art fiber structures such as shown in FIGS. 1 (*a*) through (*d*). Furthermore, inner structure 7, while having a density relatively less than the outer structure 6, also should be porous so that the inner structure fills out the entire interior of the outer structure 6. As noted above, the curling intensity or amount of crimp increases with the cross sectional asymmetry and in the fibers of the present invention, not only is there cross sectional asymmetry produced by the two large oblong lobes having an angle between the same of less than 90°, but also the variation in thickness of outer structure 6 and the variation in density between outer structure 6 and inner structure 7, produce multiple centers of gravity, i.e., the center of gravity of outer structure 6 is different than the center of gravity of inner structure 7.

The amount of crimp or curling in polyacrylonitrile may be measured by a quantity E known as curl intensity. This quantity E is the difference between the fiber lengths measured under loads corresponding to 1,000 meters of fiber and 100 meters of fiber, the difference being expressed as a percentage of uncrimped absolute length. For the purposes of the present invention and the following examples, it is assumed that the uncrimped absolute length corresponds to the length under a load of 1,000 meters of fiber, for the difference between these values is very slight. As noted above, the value E can be derived from the equation:

$$E = \frac{L_2 - L_1}{L_2} \times 100$$

wherein $L_1$ is the length of the filament under loads corresponding with 100 meters of fiber and $L_2$ is the length measured under a load corresponding to 1,000 meters of fiber.

It is noted that this value is not necessarily zero because even completely uncrimped conventional fiber is not perfectly linear and, therefore, it is generally considered that fibers having an E value between 1 and 2 have virtually no natural crimp.

The polyacrylonitrile fibers of the present invention and the process for producing the same will now be illustrated by the following examples and comparative examples which are for the purposes of illustration only and are in no way to be taken as limiting. In the following examples, all parts and percentages are by weight and all temperatures are in degress Centigrade unless otherwise indicated.

EXAMPLE 1

A copolymer comprising 93 percent acrylonitrile, 6 percent methylmethacrylate, and 1 percent methallyl sulfonate, sodium salt, is dissolved in dimethylformamide to form a 25 percent polymer solution. This polymer solution is introduced into an extruder at a temperature of 60°C. and is spun through an extrusion nozzle having 2,500 holes, each hole being 0.13 millimeter in diameter, into a first spinning bath comprising 90 percent 1,1,1-trichloroethane and 10 percent dimethylformamide at a temperature of 15°C. The spinning bath is 1.5 meters long and the filaments are spun from the nozzle at 11 meters per minute giving a gelled filament speed of 4.37 meters per minute corresponding to an exposure time of 14 seconds in the first spinning bath. At the outlet of the spinning bath, the partially coagulated filament is drawn 630 percent in a drawing bath comprising 75 percent by weight water and 25 percent by weight dimethylformamide at a temperature of 100°C. The 1,1,1-trichloroethane which is released by the heat in the second treating bath is condensed and recovered and the cable of filaments is then washed with water running countercurrent to the direction of travel of the filaments and, subsequent to rinsing, the cable is oiled and cut into short fibers measuring 180 millimeters. These fibers are then predried at a temperature of 50°C. until the fibers contain 15 percent moisture. Then, the temperature is raised to 80°C. until the moisture content of the fibers is 0.5 percent. Following this treatment, the filaments are treated with saturated steam for 30 minutes in order to produce filaments having a strength of 25 grams/tex., an elongation of 45 percent, a curling percentage of 6 percent, and an asymmetrical cross-section.

EXAMPLE 2 AND COMPARATIVE EXAMPLES 1–3

In Example 2 and Comparative Examples 1–3, the spinning solution of Example 1 is supplied to an extrusion nozzle having 200 holes, 0.14 millimeter in diameter. The spinning solution is then spun into a spinning bath containing the pure solvents as noted in Table 1 at the temperature of 20°C.

After leaving the first bath, the filaments are drawn to 700 percent in the second bath at 98°C. comprising 90 percent water and 10 percent dimethylformamide. Subsequent to this treatment, the filaments are washed, oiled, cut, boiled, dried to 50°C. and then to 80°C. and treated with saturated steam in order to produce a crimp. The physical properties including toughness, elongation, and crimp percentages are shown in Table 1.

Table 1

| | Comp. Ex. 1 Trichloro-ethylene | Comp. Ex. 2 Tetrachlor-ethylene | Ex. 2 1,1,1-Trichlor-ethane | Comp. Ex. 3 1,1,2-Tri-chloro-ethane |
|---|---|---|---|---|
| Strength gr/tex | 31.0 | 29.5 | 30.5 | 23 |
| Elongation % | 50 | 44 | 46 | 66 |
| Loop strength gr/tex | 8 | 14 | 11 | 18 |
| Loop Elong. gr/tex | 7 | 18 | 13 | 25 |
| Crimp % | 1.25 | 1.6 | 5.8 | 1.7 |

As can be seen from Table 1, only the polyacrylonitrile filaments produced by extruding the same into a spinning bath containing 1,1,1-trichloroethane have a significant crimp percentage. Also, the filaments spun into the 1,1,1-trichloroethane bath have two long oblong lobes at an angle of less than 90° with respect to each other while the other chlorinated solvents produce acrylonitrile filaments having various other cross-sections. The trichloroethylene produces filaments having a jagged cross-section without lobe formation while the tetrachloroethylene gives a conventional bean shape cross-section, see FIGS. 1(*c*) and (*d*), while the 1,1,2-trichloroethane produces polyacrylonitrile filaments having a more or less hexagonal cross-section.

EXAMPLES 3–5 AND COMPARATIVE EXAMPLE 4

In order to determine the effect of various spinning bath compositions on the shape of the polyacrylonitrile filaments and the crimping properties produced thereby, the procedure of Example 2 is repeated except that the pure spinning bath is replaced with varying concentrations of 1,1,1-trichloroethane in dimethylformamide, as shown in Table 2.

Table 2

| Bath Composition | Example 3 100% TCE | Example 4 90% TCE 10% DMF | Example 5 80% TCE 20% DMF | Comp. Ex. 4 70% TCE 30% DMF |
|---|---|---|---|---|
| Strength gr/tex | 30 | 31 | 30 | 27 |

Table 2-continued

| Bath Composition | Example 3 100% TCE | Example 4 90% TCE 10% DMF | Example 5 80% TCE 20% DMF | Comp. Ex. 4 70% TCE 30% DMF |
|---|---|---|---|---|
| Elongation % | 49 | 50 | 51 | 58 |
| Loop strength gr/tex | 10.5 | 10.8 | 12.5 | 11.8 |
| Loop Elongation % | 12 | 14 | 20 | 25 |
| Crimp % | 6.5 | 5.8 | 4 | 1 |

From the results as presented in Table 2, it is apparent that as the percentage of 1,1,1-trichloroethane decreases in the spinning bath, the crimp percentage also decreases so that when less than 75 percent by weight 1,1,1-trichloroethane is present in the spinning bath, virtually no crimp is produced. Furthermore, when pure 1,1,1-trichloroethane or 90 percent trichloroethane is utilized, fibers having cross-sections as shown in FIG. 2(*c*) and (*d*) are produced while the baths containing 70 percent 1,1,1-trichloroethane have fibers having conventional cross-sectional shapes.

EXAMPLES 6–8 AND COMPARATIVE EXAMPLE 5

In order to determine the importance of the temperature of the spinning bath, the spinning solution and extrusion nozzle of Example 2 are utilized and spun into a spinning bath of 85 percent 1,1,1-trichloroethane and 15 percent dimethylformamide at the temperatures as shown in Table 3.

Table 3

| Bath Temperature | Example 6 10°C. | Example 7 20°C. | Example 8 30°C. | Comp. Ex. 5 40°C. |
|---|---|---|---|---|
| Strength gr/tex | 25 | 26 | 25 | 24 |
| Elongation % | 52 | 50 | 49 | 56 |
| Loop strength gr/tex | 11.6 | 11.4 | 12.4 | 11.7 |
| Loop Elongation % | 16 | 13 | 18 | 24 |
| Crimp % | 6.4 | 4.9 | 3.7 | 1.2 |

As is apparent with reference to Table 3, as the temperature of the spinning bath increases, the crimping properties of the acrylonitrile fibers decrease until at 40°C., the crimp has virtually disappeared. Furthermore, in the 30°C. baths, the fibers are produced with some conventional bean shaped cross-sections, as shown in FIGS. 1 (*c*) and (*d*), although the majority of the fibers have cross sectional shapes in accordance with the present invention. Furthermore, with regard to the fibers produced by spinning into a 40°C. bath, virtually all the fibers have cross sections corresponding to shapes as shown in FIG. 1 (*c*) and (*d*). However, those fibers produced by spinning the polymer solutions into baths having temperatures of 10° and 20°C. have cross sections as shown in FIGS. 2 (*a*) through (*d*).

EXAMPLE 9

The spinning dope of Example 2 is fed to the extrusion nozzle of Example 2 at various extrusion rates so that the exposure time of the polyacrylonitrile to the 1,1,1-trichlorethane is varied from about 25 seconds to about five minutes. Subsequent to the extrusion through the baths, the fibers are all treated with the second coagulating bath in a manner similar to Example 2.

It is found that as the exposure time of the polyacrylonitrile in the spinning bath increases the amount of crimp produced decreases so that at exposure times of greater than two minutes, the crimping properties of the polyacrylonitrile fibers have virtually disappeared. Furthermore, when the exposure time is as long as five minutes, the filaments have a compact structure throughout the entire cross section as opposed to the compact dense outer structure having a various thickness and a porous relatively less dense inner structure in accordance with the present invention. This variation in structure is produced since the 1,1,1-trichlorethane has a very slow coagulation speed for polyacrylonitrile filaments. Although the polymer fibers produced utilizing exposure times of from 2 to 5 minutes are not completely compact throughout they were sufficiently compact so that there is virtually no asymmetry with regard to density in the fibers and accordingly, these fibers have little or no crimp.

Also, an acrylic fiber is spun into a bath containing 1,1,1-trichlorethane and 10 percent dimethylformamide and is plunged into a similar bath for one day at the same temperature so as to complete coagulation in this bath. Although these fibers have the lobal structure, they are completely compact throughout and have virtually no crimping properties whatsoever.

EXAMPLES 10 TO 12 COMPARATIVE EXAMPLES 6 AND 7

The procedure of Example 1 is repeated with the exception that the second coagulation bath is varied as shown in table 4, with all other treatments being the same.

Table 4

| | Drawing in | Drawing temp. | Drawing % | Crimp % |
|---|---|---|---|---|
| Comp. Ex. 6 | Air | 21°C. | 300 | 1 – 2 |
| Comp. Ex. 7 | Water | 15°C. | 300 | 1 – 2 |
| Ex. 10 | Water | 95°C. | 300 | 7 – 9 |
| Ex. 11 | Water | 95°C. | 600 | 8 – 9 |
| Ex. 12 | Water | 95°C. | 800 | 9 – 13 |

As can be seen with reference to table 4, and especially comparative Examples 6 and 7, when the partially coagulated filaments are drawn in air or in water at a temperature of 15°C., a fiber having virtually no crimp is produced, while the filaments which are fully coagulated in a water bath while being drawn to a draw ratio of 300 percent, 600 percent, or 800 percent produce polyacrylonitrile filaments having excellent crimping properties.

COMPARATIVE EXAMPLE 8

The procedure of Example 1 is repeated with the exception that the partially coagulated filaments are fully coagulated in the second bath without any drawing whatsoever and are drawn subsequent to leaving this bath at 700 percent. These filaments, although having a varying density across the cross section of the filaments, have a cross section such as shown in FIG. 1 (*d*) and do not produce any crimping whatsoever.

EXAMPLES 13, 14 AND 15

Utilizing the procedure of Example 2, the polyacrylonitrile fibers, upon leaving the second coagulating bath, are initially dried at a temperature as shown in table 5. Subsequent to this initial drying, the filaments are then fully dried and steam treated as in Example 2 to produce filaments having the crimp percentage as shown in table 5.

Table 5

| | Temperature | Crimping % |
|---|---|---|
| Example 13 | 22°C. | 8.8 |
| Example 14 | 33°C. | 7.2 |
| Example 15 | 60°C. | 6.9 |

As is apparent from table 4, when the initial drying temperature is lower, the crimp percentage is better, although the filaments initially dried at 60°C. still have a very acceptable crimp.

EXAMPLE 16

Utilizing the procedure of Example 1, the partially coagulated filaments are drawn 650 percent in a bath comprising 50 percent dimethylformamide and 50 percent water at the boiling temperature of the mixture. After the filament cable is washed, it is cut into the suitable lengths and is plunged for 20 seconds into boiling water, dried at 100°C. and treated with steam at 100°C. The resulting crimped fiber has a strength of 21 grams/tex, and elongation of 67 percent, and a crimping percentage of 12 percent.

EXAMPLE 17 AND COMPARATIVE EXAMPLES 9 AND 10

Utilizing the procedure of Example 1, the spinning dope is spun into baths containing the compositions, as shown in Table 6, at a temperature of 20°C. The partially coagulated filaments are then drawn to 630 percent in an aqueous solution containing 25 percent dimethylformamide at 100°C. These filaments are then washed, oiled, and cut, as in Example 1, and the short fibers are dried at a pre-drying temperature of 50°C., followed by treatment with saturated steam in order to produce the crimp.

Table 6

| | Example 17 Trichloroethane 1,1,1 3% of DMF | Comp. Ex. 9 Trichloro-ethane 3% of DMF | Comp. Ex. 10 1,1,2 10% of DMF |
|---|---|---|---|
| Tetre Decitex | 17 | 17 | 17 |
| Strength gr/tex | 24.5 | 23 | 26 |
| Elongation % | 53 | 66 | 54 |
| Loop strength | 9.8 | 18 | 10.7 |
| Loop Elongation | 17 | 25 | 20 |
| Crimping % | 6.0 | 1.7 | 1.1 |

Table 6-continued

| | Example 17 Trichloroethane 1,1,1 3% of DMF | Comp. Ex. 9 Trichloro-ethane 3% of DMF | Comp. Ex. 10 1,1,2 10% of DMF |
|---|---|---|---|
| Cross-section | Lobal | Hexagonal | Hexagonal |

As can be seen from Table 6, the fibers of Comparative Examples 9 and 10 have a hexagonal cross-sectional shape and have virtually no crimp, while the filaments produced in accordance with Example 17 have a lobal cross-section and a crimp percentage of 6.0 indicating a relatively good crimp.

EXAMPLE 18

The procedure of Example 1 is repeated except that the following spinning solutions or dopes are used:

A: 27 percent solution of a homopolymer of acrylonitrile in dimethylacetamide;

B: 25 percent solution of a copolymer comprising 85 percent acrylonitrile and 15 percent vinyl chloride in dimethylformamide;

C: 25 percent solution of a copolymer comprising 60 percent acrylonitrile and 40 percent methacrylic acid in dimethylformamide;

D: 20 percent solution of a copolymer comprising 50 percent acrylonitrile, 47 percent methyl methacrylate and 3 percent allyl sulfonic acid in ethylene carbonate; and E: 25 percent solution of a copolymer comprising 90 percent acrylonitrile and 10 percent vinylidene chloride in dimethyl sulfoxide.

Each of the cables produced when heat treated to develop the crimp have an excellent crimp and other physical properties.

While the process and product have been illustrated by way of the foregoing specific examples, these examples are in no way to be construed as limiting the present invention which is properly defined by way of the following appended claims.

What is claimed is:

1. A method for producing crimped polyacrylonitrile fibers comprising spinning a polymer solution of polyacrylonitrile in a solvent for said polyacrylonitrile into a cold bath to form partially coagulated filaments of said polyacrylonitrile, said bath comprising 1,1,1-trichlorethane or a mixture of 1,1,1-trichlorethane with less than 25 percent by weight of a solvent for said polyacrylonitrile, the exposure of said polyacrylonitrile in said cold bath being for a period of less than two minutes; drawing said partially coagulated filaments above 200 percent in a hot bath, said hot bath having a temperature between 60°C and the boiling point of said bath, said hot bath comprising water or mixtures of water with less than 75 percent by weight of a solvent for said polyacrylonitrile; washing said drawn and coagulated filaments; and heat treating said filaments in a free state without tension.

2. The method of claim 1 wherein the temperature of said first bath is less than 25°C and wherein the composition of said bath comprises 1,1,1-trichlorethane or mixtures of 1,1,1-trichlorethane with less than 15 percent of said solvent for polyacrylonitrile; wherein said exposure time is less than 1 minute, the temperature of the hot bath being between 80°C and 100° C.

3. The method of claim 1 wherein said filament is initially dried at a temperature of less than 60°C.

4. The method of claim 1 wherein said solvent is selected from the group consisting of dimethylformamide, dimethylacetamide, dimethylsufoxide, and ethylene carbonate.

* * * * *